US008828150B2

(12) United States Patent
Foerster et al.

(10) Patent No.: US 8,828,150 B2
(45) Date of Patent: Sep. 9, 2014

(54) METHOD FOR CARBURIZING WORKPIECES AND ITS APPLICATION

(75) Inventors: Lothar Foerster, Stuttgart (DE); Jochen Schwarzer, Ludwigsburg (DE); Thomas Waldenmaier, Freiberg/Neckar (DE)

(73) Assignee: Robert Bosch GmbH, Stuttgart (DE)

( * ) Notice: Subject to any disclaimer, the term of this patent is extended or adjusted under 35 U.S.C. 154(b) by 1107 days.

(21) Appl. No.: 12/733,866

(22) PCT Filed: Sep. 15, 2008

(86) PCT No.: PCT/EP2008/062215

§ 371 (c)(1),
(2), (4) Date: Jun. 6, 2011

(87) PCT Pub. No.: WO2009/047084

PCT Pub. Date: Apr. 16, 2009

(65) Prior Publication Data

US 2011/0277887 A1 Nov. 17, 2011

(30) Foreign Application Priority Data

Oct. 1, 2007 (DE) ..... 10 2007 047 074

(51) Int. Cl.
*C23C 8/22* (2006.01)
*C21D 1/06* (2006.01)
*C21D 1/76* (2006.01)

(52) U.S. Cl.
USPC ..... 148/235

(58) Field of Classification Search
USPC ..... 148/235, 225
See application file for complete search history.

(56) References Cited

U.S. PATENT DOCUMENTS

| | | | | |
|---|---|---|---|---|
| 4,472,209 | A | 9/1984 | Längerich et al. | |
| 6,153,030 | A * | 11/2000 | Hanisch et al. | 148/519 |
| 6,991,687 | B2 * | 1/2006 | Poor et al. | 148/235 |

FOREIGN PATENT DOCUMENTS

| | | |
|---|---|---|
| DE | 35 36452 | 2/1987 |
| DE | 102 09 382 | 9/2003 |
| EP | 0 495 30 | 4/1982 |
| EP | 0 801 24 | 6/1983 |
| JP | 2000-1765 | 1/2000 |
| JP | 2000-303160 | 10/2000 |
| JP | 2000-336469 | 12/2000 |
| JP | 2002 194 526 | 7/2002 |
| JP | 2004-519556 | 7/2004 |
| JP | 2004 33274 | 9/2005 |
| WO | 87 00889 | 2/1987 |
| WO | 030 97893 | 11/2003 |
| WO | 2004 035853 | 4/2004 |
| WO | 2007 062008 | 5/2007 |

OTHER PUBLICATIONS

ASM International, Materials Park, Ohio, Heat Treating: "Gas Carburizing", vol. 4, pp. 312-324, Aug. 1991.*

* cited by examiner

*Primary Examiner* — Jessee Roe
(74) *Attorney, Agent, or Firm* — Kenyon & Kenyon LLP

(57) ABSTRACT

A method for carburizing workpieces made of steel, particularly workpieces having outer and inner surfaces, the workpiece being held at a temperature in the range of 850 to 1050° C. in an atmosphere containing a gaseous hydrocarbon. At least two different gaseous hydrocarbons are used and/or the workpiece is alternatingly held in the atmosphere containing the gaseous hydrocarbon during a carburizing pulse and in an atmosphere free of hydrocarbon during a diffusion phase. Also described is a use of the method.

7 Claims, 1 Drawing Sheet

METHOD FOR CARBURIZING WORKPIECES AND ITS APPLICATION

FIELD OF THE INVENTION

The present invention relates to a method for carburizing workpieces made of steel, particularly workpieces having outer and inner surfaces. The present invention also relates to an application of the method.

BACKGROUND INFORMATION

Methods for carburizing workpieces made of steel are used to harden the surface of the workpieces. In order to do this, in workpieces made of steel the surface layer of a low carbon steel is enriched before hardening of the workpiece takes place.

The carburizing takes place, for example, as low pressure carburizing. To this end, the workpieces are inserted into a vacuum furnace having a process chamber, to perform the carburizing. The process chamber has a process gas, that gives off carbon, flowing through it, in order to enrich the surface region of the workpieces with carbon.

In low pressure carburizing having thermal decomposition of the process gas, generally of hydrocarbons, in the process chamber, the process gases are generally injected during the individual process steps in a pulsating manner, the process chamber being alternatingly evacuated and/or exposed to flushing with nitrogen.

Such a method is discussed in DE-A 102 09 382, for example. In this case, the volume flow of the carburizing medium is regulated and varied in a controlled manner, during a pressure pulse, in such a way that uniform carburizing of a workpiece, that is to be carburized, is achieved.

However, in some workpieces it may be desirable that the surface of the workpiece have different hardnesses. This is the case, for instance, as discussed in DE-A 35 36 452, in the case of fuel injector nozzles for internal combustion engines. In that case it is required that the regions of the valve seat demonstrate a lower hardness than the outer region. In that case, the different hardness is achieved by first removing a part of the layer of the carburized and nitrided or nitrocarburized outer wall region, after the carburizing and after the nitriding or nitrocarburizing, before hardening the workpiece.

A disadvantage of this method is that the workpiece has to be manufactured oversized, so that after the carburizing or nitriding or nitrocarburizing one is still able to remove material.

SUMMARY OF THE INVENTION

In the method according to the present invention for carburizing workpieces made of steel, particularly of workpieces having outer and inner surfaces, the workpiece is held at a temperature in the range of 850 to 1050° C. in an atmosphere containing a gaseous hydrocarbon. At least two different gaseous hydrocarbons are used and/or the workpiece is alternatingly held in the atmosphere containing the gaseous hydrocarbon during a carburizing pulse and an atmosphere free of hydrocarbon during a diffusion phase.

Because of the different hydrocarbons and the carburizing pulses, it is possible to carburize outer and inner surfaces of the workpiece to a different extent. The outer surfaces are generally carburized to a greater extent than the inner surfaces. Owing to the method according to the present invention, it is even possible, when desired, that the inner surfaces are not carburized at all, and only the outer surfaces of the workpiece are carburized.

A reduction of carburizing of inner surfaces is particularly achieved in that the duration of a carburizing pulse, in which the workpiece is held in the atmosphere containing the gaseous hydrocarbon, amounts to at most 30 seconds. The duration of a carburizing pulse of at most 30 seconds may particularly be if the carburizing is performed at low pressure. In that case, the gaseous hydrocarbon is injected into an oven chamber in which the workpiece, that is to be carburized, is contained. To end the carburizing pulse, the oven chamber is flushed with an inert gas. Alternatively, it is also possible to evacuate the oven chamber so as to end the carburizing pulse. When the oven chamber is flushed, this may be done using nitrogen. The advantage of flushing with nitrogen over evacuating the oven chamber is that when flushing is used it speeds up the removal of the gaseous hydrocarbons from the oven chamber.

Because of the duration of a carburizing pulse, in which the workpiece is held in the atmosphere containing the gaseous hydrocarbon, of a maximum of 30 seconds, it is possible to carburize specifically mainly outer surfaces of the workpiece. In the case of pulses of a longer duration, by contrast, an almost uniform carburizing of all surfaces is achieved.

In order specifically to set the material properties, it is also possible to use both pulses having a duration of less than 30 seconds and longer pulses. Consequently, during the shorter pulses it is chiefly the outer surface of the workpiece that is carburized, and during the longer pulses carburizing of all surfaces of the workpiece takes place. This leads to a weaker carburizing of the inner surfaces and a stronger carburizing of the outer surfaces.

If at least two different gaseous hydrocarbons are used, then in a first exemplary embodiment it is possible that the at least two different hydrocarbons are contained in the atmosphere containing the gaseous hydrocarbon at the same time. However, alternatively it is also possible that the different hydrocarbons are used one after the other. Alternatively, it is further also possible to expose the workpiece, that is to be carburized, alternatingly to an atmosphere having only one gaseous hydrocarbon and to an atmosphere having a mixture of various gaseous hydrocarbons.

If the different gaseous hydrocarbons are contained simultaneously in the atmosphere containing the gaseous hydrocarbons, it is possible to expose the workpiece that is to be carburized to the atmosphere containing the gaseous hydrocarbons in only one processing step. A plurality of carburizing pulses may be performed even if the plurality of hydrocarbons are contained in the atmosphere at the same time. Because of the carburizing pulse, the material properties may be adjusted even more precisely than by the simultaneous use of the at least two different hydrocarbons.

In one additional exemplary embodiment of the method according to the present invention, in at least two successive carburizing pulses, the partial pressure of the hydrocarbon in the atmosphere containing the gaseous hydrocarbons is different. Because of the different partial pressure of the hydrocarbon in the atmosphere containing the gaseous hydrocarbon, it is also possible to carburize the outer surfaces more greatly than the inner surfaces. The greater carburizing of the outer surfaces is achieved by increasing the partial pressure of the hydrocarbon. Correspondingly, by lowering the partial pressure of the hydrocarbon in the atmosphere containing the gaseous hydrocarbons, one may achieve that the inner surfaces are less strongly carburized.

The falling off of the partial pressure of the hydrocarbon in the atmosphere containing the gaseous hydrocarbon is able to take place, for example, if an inert gas is mixed in at constant overall pressure. One suitable inert gas is nitrogen, for example. Additional suitable gases are helium and argon. However, nitrogen may particularly be the inert gas.

Alternatively it is also possible to obtain a reduction in the partial pressure of the hydrocarbon, in the atmosphere containing the gaseous hydrocarbon, by reducing the overall pressure.

Alternatively it is also possible to reduce the partial pressure by the addition of a further hydrocarbon at constant pressure. This is possible in particular if different hydrocarbons are to be used for the carburizing. In this case, the reduction in the partial pressure takes place using a hydrocarbon by which especially outer surfaces of the workpiece are carburized.

When only one hydrocarbon is used for carburizing, the hydrocarbon may be unsaturated. It may especially be that the hydrocarbon is doubly unsaturated. A doubly unsaturated hydrocarbon penetrates even better into bores, for example, than a singly unsaturated hydrocarbon. Furthermore, short-chain hydrocarbons may be used. By contrast to saturated hydrocarbons, when using unsaturated hydrocarbons, especially doubly unsaturated hydrocarbons, inner surfaces of the workpiece may also be carburized. However, if carburizing only outer surfaces of the workpiece is required, using saturated hydrocarbons or, if necessary, singly unsaturated hydrocarbons may be used.

In order to be able specifically to adjust the material properties, however, when using at least two different hydrocarbons, at least one hydrocarbon is saturated and at least one hydrocarbon is unsaturated, or which may be, at least one hydrocarbon is doubly unsaturated and at least one hydrocarbon is singly unsaturated. Because of the saturated or the singly unsaturated hydrocarbon, outer surfaces of the workpiece are carburized above all, and because of the singly unsaturated, or which may be doubly unsaturated hydrocarbon, both outer and inner surfaces are carburized. The thickness of the carburizing of the inner surfaces is able to be set by the partial pressure of the unsaturated or singly unsaturated hydrocarbon.

When the carburizing of the workpiece takes place using carburizing pulses, it is possible, at a duration of the carburizing pulses of at most 30 seconds, and independently of the hydrocarbon used, to carburize outer surfaces, above all. However, even using correspondingly shorter carburizing pulses, the carburizing of the outer surfaces is supported and the carburizing of the inner surfaces is prevented if saturated hydrocarbons are used. If the inner surfaces are also to be carburized, however, unsaturated, and which may be doubly unsaturated hydrocarbons may be used in combination with carburizing pulses, whose duration exceeds 30 seconds.

The saturated hydrocarbon used for carburizing may be a $C_1$- to $C_6$-alkane. The saturated hydrocarbons methane, ethane and propane may especially be used.

The unsaturated hydrocarbon may be a $C_2$- to $C_6$-alkene or a $C_2$- To a $C_6$-alkyne. It particularly may be that the unsaturated hydrocarbon is an ethene or an ethyne, or a mixture thereof.

Thus, for example, when an ethyne is used as the hydrocarbon for carburizing workpieces made of steel, it turns out that it makes possible a good carburizing of inner surfaces, for instance, borings. For this purpose, however, it is necessary to expose the workpiece sufficiently long to the atmosphere containing the ethyne. If the ethyne is contained only for a short time period, especially less than 30 seconds, in the atmosphere for carburizing the workpiece, then in this case, too, there is a reduction in the carburizing of the inner surfaces, and above all, the outer surfaces are carburized.

By contrast, when using methane or ethane, for example, only the outer surface of the workpiece is carburized, even in response to longer carburizing pulses. Only a slight carburizing effect shows at the inner surfaces.

The method according to the present invention makes it possible, for example, by using different hydrocarbons and/or short carburizing pulses, to carburize outer surfaces of the workpiece in a more pronounced manner than inner surfaces.

After carburizing, the workpiece made of steel is usually hardened. To do this, the workpiece is quenched by suddenly cooling the workpiece that has the quenching temperature. By quenching temperature one should understand the temperature from which a workpiece is quenched.

The quenching takes place, for example, in an oil bath. However, especially in the case of low pressure carburizing, gas quenching is carried out. As a result, there is a higher residual austenite content in the more strongly carburized areas.

Consequently, the method is particularly suitable for the production of workpieces in which regions having greater hardness and regions having lesser hardness are required. In this context, regions having lesser hardness have a lower residual austenite content, or rather have almost no residual austenite. This is desirable especially in cases where particularly high requirements are made on dimensional stability and deformation resistance. This may be attributed to the fact that the residual austenite is softer than martensite. In addition, the later conversion of the residual austenite to martensite during operation leads to a volume change in the microstructure.

In one exemplary embodiment, the method is used for carburizing a nozzle body of an injection valve, especially a fuel injector. Such a nozzle body includes a region for a valve seat, a guideway for a valve member and an outer surface. Because of the method according to the present invention, the outer surface and the guideway of the valve member are carburized more, and the region of the valve seat is carburized slightly. Upon subsequent quenching, this leads to the outer surface and the guideway for the valve member having a greater hardness than the area of the valve seat.

In particular, because of the different carburizing of the nozzle body, a higher residual austenite content sets in at the outer surface and the guideway of the valve member, and a lower residual austenite content in the area of the valve member. Based on the lower residual austenite content in the area of the valve seat, the necessary high requirements on the dimensional stability and deformation resistance are able to be maintained. The high requirements on the dimensional stability and deformation resistance in the area of the valve seat come about particularly because, at the high pressures which occur particularly in self-igniting internal combustion engines, the tight closing of the injector valve must be made possible, so that no fuel is able to penetrate through the injector valve into the combustion chamber of the internal combustion engine when the injector valve is closed.

By contrast, it is necessary, however, to provide a great surface hardness in the area of the guideway of the valve member. The wear on the nozzle body, caused by the movement of the valve member, is able to be reduced because of the great surface hardness. In addition, a great rigidity in the area of the guideway of the valve member is required. This is also achieved by great surface hardness.

Because of the application of the method according to the present invention, nozzle bodies for injector valves are able to be casehardened by low pressure carburizing in such a way that, in the area of the valve seat there is almost no residual austenite, whereby the required dimensional stability and deformation resistance are able to be fulfilled, while in the area of the guideway of the valve member, and at the outer surface of nozzle body a maximum surface hardness is achieved at an appropriately high content of residual austenite.

Exemplary embodiments of the present invention are depicted in the drawings and described in greater detail in the description below.

DETAILED DESCRIPTION

Figure 1:
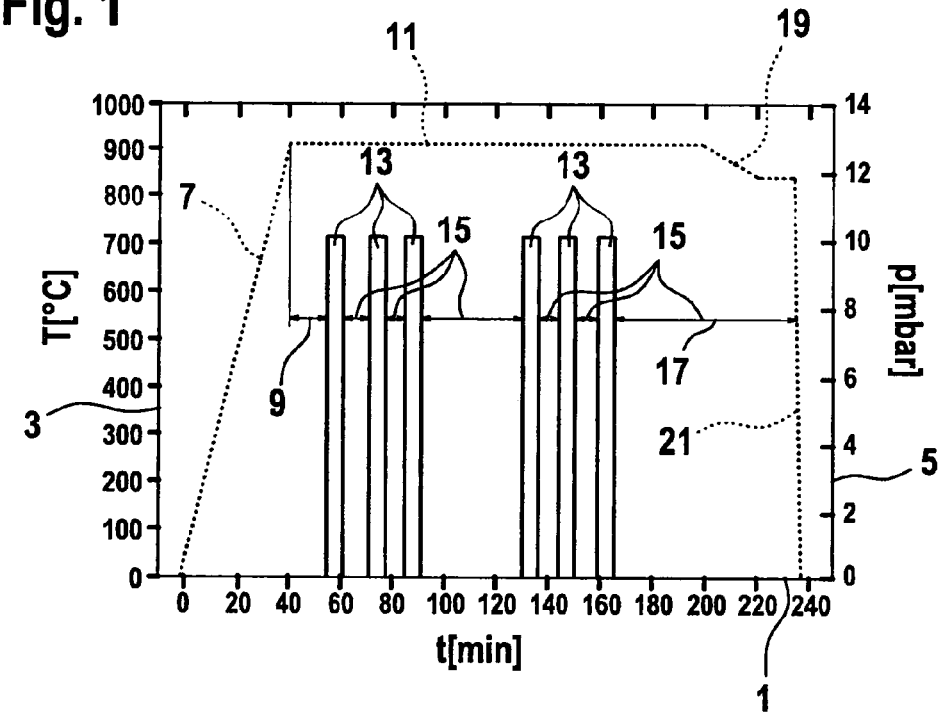
FIG. 1 shows a pressure and temperature curve as a function of time, according to the method of the present invention.

FIG. 1 shows the pressure and temperature curves as a function of time for the method according to the present invention.

The method for carburizing workpieces made of steel is generally performed at low pressure operation. During the carburizing of the workpiece, the pressure is generally within the range of 1 to 30 mbar, in this context. The pressure may be in the range from 4 to 10 mbar.

In the diagram shown in FIG. 1, time t is plotted on abscissa 1, temperature T is plotted on ordinate 3 and pressure p is plotted on second ordinate 5.

In the method according to the present invention, the workpiece is heated to carburizing temperature in a first step 7. The carburizing temperature is generally in the range of 880 to 1050° C., which may be in the range of 900 to 1000° C. The temperature at which the workpiece is exposed to a carburizing atmosphere is designated as the carburizing temperature, in this context.

After being heated to casehardening temperature, the workpiece is heated through, in a first holding phase 9, to the carburizing temperature. Carburizing temperature 11 is held essentially constant during the entire carburizing process.

After first holding phase 9, carburizing pulses 13 take place. Each carburizing pulse 13 is followed by a diffusion phase 15.

In the exemplary embodiment shown here, the partial pressure of the hydrocarbon used in carburizing pulses 13 amounts to 10 mbar. The partial pressure of the hydrocarbon during carburizing pulse 13 is generally in the range of 1 to 30 mbar, which may be in the range of 4 to 10 mbar. During each carburizing pulse 13, a permanent gas exchange prevails by flushing with the process gas. The process gas contains the hydrocarbon used for the carburizing. It is furthermore possible that the process gas also contains inert components.

In addition to using only one hydrocarbon, which may be a $C_2$- to $C_6$-alkene, or $C_2$- to $C_6$-alkyne, and which may be ethene or ethyne, one may also use a mixture of a plurality of different hydrocarbons. If different hydrocarbons are used, beside the unsaturated hydrocarbon, one may also use saturated hydrocarbons, which may be $C_1$- to $C_6$-alkanes. As the saturated hydrocarbons, methane, ethane and propane may especially be used. However, a mixture of doubly or singly unsaturated hydrocarbons may be used, and particularly a mixture of ethane and ethyne may be used.

In the exemplary embodiment shown in FIG. 1, first of all three carburizing pulses are carried out. After the three carburizing pulses, a longer diffusion phase takes place. After the longer diffusion phase 15, again, three carburizing pulses 13 are carried out.

Besides the exemplary embodiment shown in FIG. 1, in which three carburizing pulses 13 are carried out twice, it is also possible that fewer carburizing pulses 13 are carried out or even more than three carburizing pulses. It is also possible that the diffusion phases 15 are of the same length after each carburizing pulse 13, or that after each carburizing pulse 13 a diffusion phase 15 takes place of different length. The duration of diffusion phases 15 is selected in each case so that the hydrocarbon content, desired in each case after the carburizing pulse 13, sets in at the surface of the workpiece that is to be carburized.

During diffusion phases 15, the process gas, that is, the gas containing the hydrocarbon, is pumped off. Alternatively, it is also possible that the oven chamber, in which the carburizing is carried out, is flushed using an inert gas after each carburizing pulse 13. It is also possible that, during diffusion phases 15, the pumping off of the process gas and the flushing of the chamber take place at the same time.

During carburizing pulses 13, a pure hydrocarbon or a hydrocarbon mixture is injected into the oven chamber, for example. Besides using a pure hydrocarbon or hydrocarbon mixture during the carburizing pulses, it is also possible to use a mixture of hydrocarbons and inert gases.

Nitrogen and noble gases are suitable as inert gases, for example.

In this context, one may use the same hydrocarbon or the same hydrocarbon mixture for all carburizing pulses 13, or different hydrocarbons or hydrocarbon mixtures are used for different carburizing pulses 13.

Any inert gas is suitable for flushing the chamber after carburizing pulses 13. In particular, when using a gas mixture of hydrocarbon and inert gas during carburizing pulses 13, the same inert gas is used for flushing as the one that is used during carburizing pulses 13.

A closing diffusion phase 17 follows the last carburizing pulse 13, whose duration is selected in such a way that the desired hydrocarbon content sets in on the surface of the workpiece that is to be carburized. During the final diffusion phase 17, the temperature of the workpiece may be lowered to hardening temperature. This is shown by reference numeral 19. The hardening temperature may be in the range of 800 to 950° C., particularly in the range of 820 to 900° C.

Subsequently to closing diffusion phase 17, the workpiece is hardened by quenching 21. For the quenching, the workpiece is dipped into an oil bath, for example. In the oil bath a sudden cooling of the workpiece takes place. However, gas quenching may be used.

During the carburizing of the workpiece, it is possible, for instance, during a few carburizing pulses 13, to use an unsaturated hydrocarbon, which may be ethene or ethyne, and especially it may be a doubly unsaturated hydrocarbons, particularly ethyne, and during additional carburizing pulses to use a mixture of saturated and unsaturated hydrocarbons, for instance, a mixture of ethane and ethyne, or which may be a mixture of singly or doubly unsaturated hydrocarbons, particularly ethene and ethyne, or only saturated hydrocarbons. During the carburizing process, outer surfaces of the workpiece are carburized both using the saturated and the unsaturated hydrocarbon, whereas inner surfaces, for instance, the surfaces within bores, are carburized mainly by the unsaturated hydrocarbon, especially a doubly unsaturated hydrocarbon.

Especially in the case of the use of saturated and unsaturated hydrocarbons, or of singly and doubly unsaturated hydrocarbons for the carburizing, this leads to the surfaces inside the bores being carburized essentially by the unsaturated hydrocarbon, particularly the doubly unsaturated hydrocarbon, and thus having an essentially lower carburizing depth than outer surfaces. Directly on the surface of the workpiece, however, the concentration of carbon is generally comparable at the inner surfaces and the outer surfaces. However, one may also adjust the surface concentration on inner surfaces in a controlled manner. In this context, the concentration is a function of when a hydrocarbon is used for carburizing inner surfaces, and how long diffusion takes place subsequently.

In addition to using carburizing pulses and/or different hydrocarbons it is also possible, especially in order to completely prevent carburizing in certain areas, to cover these areas by suitable covering devices or covering arrangements. Suitable covering devices or covering arrangements are covering pastes, for example. By using such covering arrangements or covering devices, areas are however not carburized at all. Using this technique, one cannot achieve slight carburizing. By contrast, the method according to the present invention permits carburizing areas only slightly, while other areas of the workpiece are strongly carburized.

Figure 2:
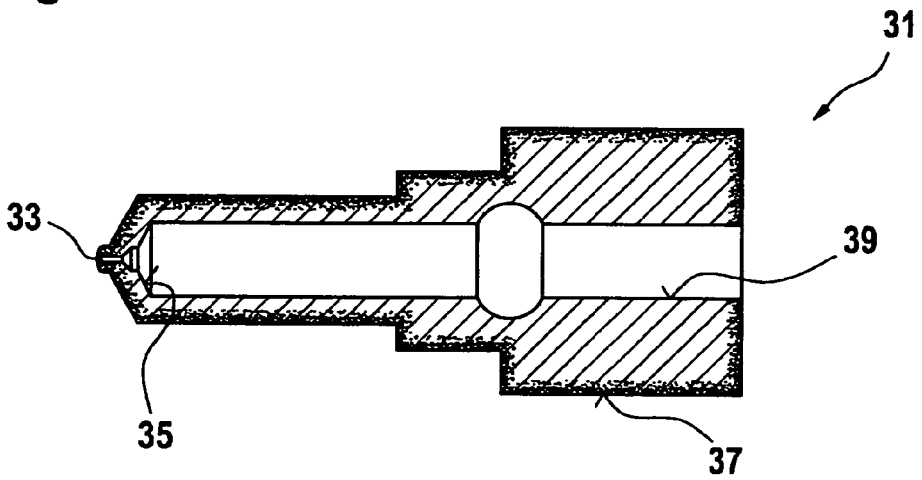
FIG. 2 shows a nozzle body for an injector valve.

FIG. 2 depicts a nozzle body of a fuel injector.

An injection orifice 33 is developed in nozzle body 31 for a fuel injector. In the operation of the fuel injector, fuel is injected into a combustion chamber of an internal combustion engine via injection orifice 33. In order for the fuel to be injected into the combustion chamber at desired points in time, injection orifice 33 is able to be closed with the aid of a valve member that is not shown here. In order to close injection orifice 33, the valve member is set into a valve seat 35 using a sealing edge. Valve seat 35 developed to be conical in the exemplary embodiment shown here.

Very high requirements for dimensional accuracy are set on valve seat 35, so that the valve member tightly closes injection orifice 33, even during the high fuel pressures that occur during the injection process. In addition, it is required that, even during operation, no change of shape of valve seat 35 occurs, for instance, by the conversion of residual austenite. For this reason it is desirable that the area of valve seat 35 is not carburized, or only very slightly so, during the carburizing of nozzle body 31. The slight carburizing depth is achieved by the method according to the present invention, in which inner surfaces, such as valve seat 35, are carburized only slightly by the use of short carburizing pulses and/or unsaturated hydrocarbons.

By contrast, it is desirable that outer surface 37 of nozzle body 31 be strongly carburized, so as to achieve a greater hardness. Because of the greater hardness at outer surface 37, the resistance to wear by abrasion on outer surface 37 is reduced. It is also desirable that the region of the guideway of valve member 39 be carburized more strongly, in order to minimize here, too, wear and metal abrasion caused by friction, based on the motion of the valve member. The method according to the present invention makes it possible greatly to carburize the guideway of valve member 39 and outer surface 37 of nozzle body 31, and to carburize valve seat 35 only slightly. Because of this, in the area of valve seat 35, a low residual austenite content is achieved during the hardening that follows the carburizing. By contrast, the residual austenite content at outer surface 37 and in the region of the guideway of valve member 39 is higher.

In addition to nozzle bodies for injector valves, the method according to the present invention is also suitable, for example, for carburizing piston bores, that is, long bores which have to have good dimensional stability and deformation resistance, so as to avoid a so-called "seizing", in which respectively inner surfaces are only slightly carburized or not at all, and outer surfaces are strongly carburized.

What is claimed is:

1. A method for carburizing a workpiece made of steel, the workpiece having outer surfaces and inner surfaces, the method comprising:

holding the workpiece at a temperature in a range of 850 to 1050° C. in an atmosphere containing gaseous hydrocarbon;

providing at least two different gaseous hydrocarbons in the atmosphere; and alternatingly holding the workpiece in the atmosphere containing the gaseous hydrocarbon during a carburizing pulse and in an atmosphere free of hydrocarbon during a diffusion phase;

wherein the workpiece is held in the atmosphere containing the gaseous hydrocarbon for no more than 30 seconds.

2. A method for carburizing a workpiece made of steel, the workpiece having outer surfaces and inner surfaces, the method comprising:

holding the workpiece at a temperature in a range of 850 to 1050° C. in an atmosphere containing gaseous hydrocarbon;

providing at least two different gaseous hydrocarbons in the atmosphere; and alternatingly holding the workpiece in the atmosphere containing the gaseous hydrocarbon during a carburizing pulse and in an atmosphere free of hydrocarbon during a diffusion phase;

wherein in at least two successive carburizing pulses, the partial pressure of the hydrocarbon in the atmosphere containing gaseous hydrocarbons is different.

3. A method for carburizing a workpiece made of steel, the workpiece having outer surfaces and inner surfaces, the method comprising:

holding the workpiece at a temperature in a range of 850 to 1050° C. in an atmosphere containing gaseous hydrocarbon;

providing at least two different gaseous hydrocarbons in the atmosphere; and alternatingly holding the workpiece in the atmosphere containing the gaseous hydrocarbon during a carburizing pulse and in an atmosphere free of hydrocarbon during a diffusion phase;

wherein at least one of the different hydrocarbons and the carburizing pulses are used so that the outer surfaces of the workpiece absorb more carbon than the inner surfaces of the workpiece.

4. A method for carburizing a workpiece made of steel, the workpiece having outer surfaces and inner surfaces, the method comprising:

holding the workpiece at a temperature in a range of 850 to 1050° C. in an atmosphere containing gaseous hydrocarbon; and performing at least one of (i) providing at least two different gaseous hydrocarbons in the atmosphere, and (ii) alternatingly holding the workpiece in the atmosphere containing the gaseous hydrocarbon during a carburizing pulse and in an atmosphere free of hydrocarbon during a diffusion phase;

wherein the workpiece is a nozzle body of a fuel injector valve, including a region for a valve seat, a guideway for a valve member and an outer surface (37), so that an outer surface and the guideway for the valve member absorbs more carbon than an area of the valve seat, so that the outer surface and the guideway for the valve member have a greater hardness than the area of the valve seat.

5. The method of claim 4, wherein the hydrocarbon contained in the gaseous atmosphere is one of unsaturated and doubly unsaturated.

6. The method of claim 5, wherein the saturated hydrocarbon includes a $C_2$-to $C_6$-alkane, and wherein the unsaturated hydrocarbon includes one of a $C_2$-to $C_6$-alkene and a $C_2$-to $C_6$-alkyne.

7. The method of claim 6, wherein the $C_2$-to $C_6$-alkane is a propane, and the $C_2$-to $C_6$-alkyne is at least one of an ethene, an ethyne, and a propyne.

* * * * *